US007735678B2

(12) United States Patent
Rushe et al.

(10) Patent No.: US 7,735,678 B2
(45) Date of Patent: Jun. 15, 2010

(54) CONTAINER AND COMBINATION PACKAGING

(75) Inventors: Peter Rushe, Dusseldorf (DE); Liam P. O'Dwyer, Celbridge (IE); Geoffrey F. Seymour, Kilmacanogue (IE); David J. Gibson, Celbridge (IE); Patrick Kealy, Dublin (IE)

(73) Assignee: Loctite (R&D) Limited, Dublin (IE)

( * ) Notice: Subject to any disclaimer, the term of this patent is extended or adjusted under 35 U.S.C. 154(b) by 184 days.

(21) Appl. No.: 10/599,688

(22) PCT Filed: Apr. 5, 2005

(86) PCT No.: PCT/IE2005/000037

§ 371 (c)(1),
(2), (4) Date: Jun. 22, 2007

(87) PCT Pub. No.: WO2005/097602

PCT Pub. Date: Oct. 20, 2005

(65) Prior Publication Data

US 2007/0241108 A1 Oct. 18, 2007

(51) Int. Cl.
*B65D 51/04* (2006.01)

(52) U.S. Cl. ..... 220/837; 206/807; 206/736; 215/901

(58) Field of Classification Search ..... 220/257.2, 220/23.87, DIG. 34; 206/736, 767, 45.28, 206/461, 45.25, 1.5, 470, 807; 215/901
See application file for complete search history.

(56) References Cited

U.S. PATENT DOCUMENTS

| | | | | |
|---|---|---|---|---|
| 1,956,642 | A * | 5/1934 | Einson | 206/45.25 |
| 4,632,242 | A | 12/1986 | Choi et al. | |
| 5,344,004 | A * | 9/1994 | Meyer | 206/45.25 |
| 5,971,261 | A * | 10/1999 | Grunfeld et al. | 229/102 |
| 6,398,067 | B1 * | 6/2002 | Belfance et al. | 220/833 |
| 2002/0063078 | A1 * | 5/2002 | Garrett | 206/461 |
| 2003/0029756 | A1 * | 2/2003 | Vasudeva et al. | 206/379 |
| 2004/0217032 | A1 * | 11/2004 | Cunningham et al. | 206/461 |

FOREIGN PATENT DOCUMENTS

| | | |
|---|---|---|
| WO | WO 03/064275 | 8/2003 |

OTHER PUBLICATIONS

International Search Report for PCT Application No. PCT/IE2005/000037 dated Jan. 11, 2006.

* cited by examiner

*Primary Examiner*—Anthony Stashick
*Assistant Examiner*—Jeffrey Allen
(74) *Attorney, Agent, or Firm*—Steven C. Bauman

(57) ABSTRACT

The invention relates to an outer container for holding an inner container in particular where the inner container has a sensitive product. The outer container comprises at least one of a moveable display board; retaining formations for retaining a hygroscopic element; or a stand for gripping the base of the inner container to retain it in an upright position. The invention also relates to a combination pack comprising the inner container retained in the outer container, particularly where the inner container holds a moisture sensitive product such as an adhesive.

19 Claims, 10 Drawing Sheets

CONTAINER AND COMBINATION PACKAGING

BACKGROUND TO THE INVENTION

Field of the Invention

The present invention relates generally to the field of packs/packaging, and in particular to outer containers suitable for retaining internally internal containers which may be dispensing packs/packaging.

It is desired to provide inexpensive re-useable dispensing packs, which offer the user the opportunity to partially dispense the contents of a container and store the remainder for later use. The user can dispense as much of the contents as required and then re-close (or reseal) the pack to store the contents for a future use. Re-sealing the pack is important particularly for materials, which are sensitive to their environment for example products, which are sensitive to air, moisture and/or light. It is desirable to provide the aforementioned sensitive material in a container and/or pack that will prolong the usable life of the product by protection from environmental conditions. Also for consumer-oriented products, it is desirable to provide a display friendly packaging which appeals to the consumer and which can be readily displayed by a retailer, particularly for point of sale display.

There exists a requirement for a low cost multi-use pack. While the present invention can also provide a packing for a single use or "one shot" disposable pack it is intended primarily for providing a pack which can be used on a multiplicity of occasions and over time.

SUMMARY OF THE INVENTION

The present invention provides a low cost multi-use pack. In particular it is desired to provide a combination pack, which is suitable for storage of environment sensitive products such as adhesive and other curable products. It is also an object of the invention to provide an outer container for use in such packs.

To this end, the invention relates to an outer container for holding an inner container in particular where the inner container has a sensitive product. The outer container comprises at least one of a moveable display board; retaining formations for retaining a hygroscopic element; or a stand for gripping the base of the inner container to retain it in an upright position. The invention also relates to a combination pack comprising the inner container retained in the outer container, particularly where the inner container holds a moisture sensitive product such as an adhesive.

BRIEF DESCRIPTION OF THE DRAWINGS

The present invention will now be described in more detail with reference to the following Figures.

DETAILED DESCRIPTION OF THE INVENTION

Figure 1:
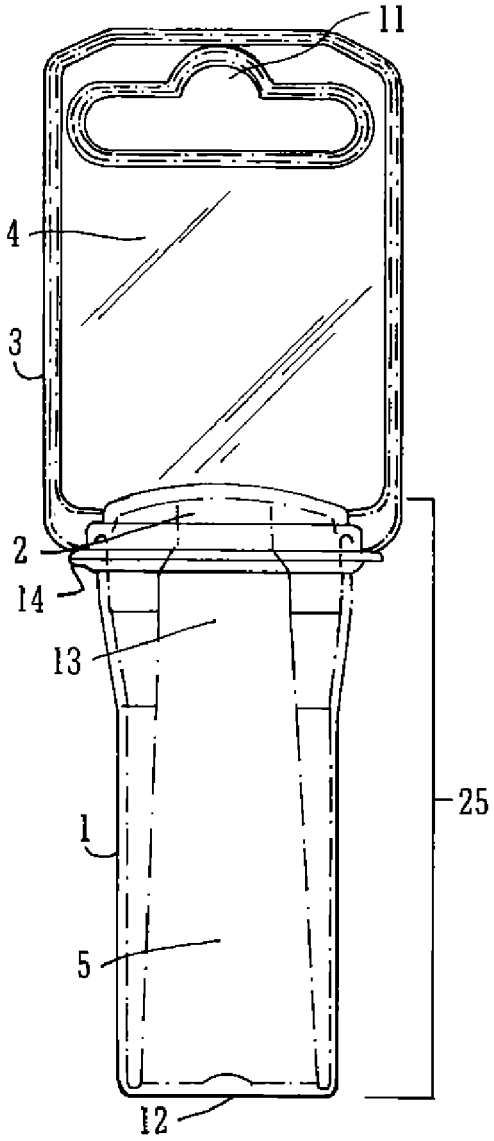
FIG. 1—Front view of the outer container.

In particular the present invention has certain aspects as set out below.

First Aspect of the Invention

Display Board

A first aspect of the present invention provides (an outer) a container (for retaining an inner container), the (outer) container having a front display side and a rear side comprising:

(i) a container body defining a housing into which an object or material (the inner container) can be placed and a mouth through which the object or material (inner container) can be placed into the housing;

(ii) a closure for the mouth of the container body for closing an object or material (the inner container) within the housing;

(iii) a (flat) display board hingedly connected to the (outer) container by at least one hinge portion and having a display panel on which product information can be displayed, the display board being rotatable about at least one hinge portion between a first position wherein the display board is held in a position where the display panel faces in the same direction as the front display side of the container and in the second position the display panel faces in the same direction as the rear side of the outer container.

The object or material is desirably an inner container.

Second Aspect of the Invention

Stand for Inner Container

A second aspect of the present invention provides an outer container for retaining an inner container with a dispensing end and a base end, the outer container comprising:

(i) a container body defining a housing into which the inner container can be placed and a mouth through which the inner container can be placed into the housing;

(ii) a closure for the mouth of the container body for closing the inner container within the housing;

the closure having provided, on an underside thereof, a stand for receiving and gripping the base end of the inner container and being arranged for retaining the inner container upright or substantially upright relative to the underside of the closure.

Third Aspect of the Invention

Combination Pack for Water Sensitive Material

The invention relates in a third aspect to a combination pack comprising outer and inner containers wherein the inner container is retained in the outer container, the outer container comprising:

(i) a container body defining a housing into which the inner container can be placed and a mouth through which the inner container can be placed into the housing;

(ii) a closure for the mouth of the container body for closing the inner container within the housing;

(iii) retaining formations on the outer container for retaining a hygroscopic element within the housing;

the inner container comprising:

(i) a container body defining a housing into which product can be placed and a mouth through which product can be dispensed;

(ii) a closure for the mouth of the container body; and the combination package further comprising a water sensitive material within the container body.

Combined Aspects of the Invention

It will be appreciated that all aspects of the invention may be utilised in combination or in any suitable sub-combination.

In particular the features of the outer containers from the first and second aspects of the invention may be combined as desired in particular to provide a display board and a stand within the same construction and the present invention relates to such a construction and also to a combination pack comprising such an outer container.

The features of the outer container from the first and third aspects may also be combined as may be the features of the outer container second and third aspects.

This invention also relates to a combination pack comprising an outer container with any one of the combinations of features described above and an inner container.

All Aspects of the Invention

The following description will describe features of the aspects of the invention described above and applies as appropriate to any aspect or combined aspect(s) which are employed.

Desirably the outer container has a base end and a top end and the opening is at the top end thereof. The base of the outer container is desirably arranged to maintain the outer container in a standing position when placed in an upstanding position on the base thereof. The base will also support the combination pack i.e. when the inner container is in situ within the outer container. It is also desirable that the container is constructed of transparent or translucent material. For example the outer container may be constructed of a natural or coloured plastics material (as discussed in more detail below).

Desirably the outer container is made of a rigid material. Forming the outer container in this way ensures that the inner container cannot be unintentionally squeezed by inadvertent pressure.

In a preferred arrangement the closure for the mouth of the outer container takes the form of a lid or cap which is mounted on the container body. Suitably at least one flexible hinge is provided between the container body and the lid. The hinge portion may be formed by a piece of flexible plastics. Optionally the hinge is reinforced suitably by provision of one or more reinforcing pieces on the hinge. In one construction it is desirable that the lid opens to one side of the container, i.e., that the flexible hinge is provided on a side wall of the outer container which is located between the front display side and the rear side thereof. Desirably the lid is a snap-fit to the container. A grip (a hand grip such as a thumb grip) may be provided on the lid for ease of opening and closing of the lid.

In one arrangement, the underside of the closure has formed thereon a stand, which comprises a slot into which the base of the inner container can be placed. The stand may be formed by upstanding members on the underside of the closure. Desirably the upstanding members form opposing grips for gripping opposing sides of the base of the inner container. In one arrangement two pairs of opposing grips are provided on the underside of the closure for gripping the base end of the inner container at positions spaced apart from each other. In particular it is desirable that the stand is arranged (to form a slot) for engaging the base end of an inner container, which has been formed by crimping.

Desirably the closure has a continuous upright member on the underside of the closure, which together with an outer rim on the closure forms an annular channel between the continuous upright member and an inner wall of the rim of the closure. When the mouth of the outer container is closed by the closure, a rim about the mouth of the outer container seats into the channel on the underside of the closure thereby providing an airtight seal between the closure and the outer container. Desirably, the outer container further comprises a rim which prevents the closure from being pushed too far down the container body when the closure is covering the mouth of the outer container.

Desirably the retaining formations for retaining the hygroscopic element on the outer container are provided on the underside of the closure. The hygroscopic element is desirably a desiccant material, which is in a pre-formed shape. The retaining formations are arranged to grip and engage the pre-formed desiccant material. The desiccant material may be of any known type though desiccant material formed of multiple layers of fibrous or polymer materials or molecular sieves are desirable. Desirably however it is the form of a pellet or tablet which can be gripped between the retaining formations. For example the pre-formed desiccant material can be in a generally cylindrical shape. Suitable pre-formed desiccant materials sold under the trade name POLLY DESICCANT are available from the following commercial source: Shanghai Polly Technology Development Co., Ltd. Shanghai, China and as advertised on the website: www.pollydesiccant.com. These desiccant materials are generally of the fibrous type. Desiccants of the molecular sieve type are available from Süd-Chemie with various facilities including one in New Mexico and from their website: www.sud-chemie.com. Desirably, the desiccant is in the form of a desiccant capsule. The desiccant may be for example a desiccant capsule comprising a silica gel held in a plastics (for example polypropylene) shell and covered with a cardboard disc.

Desirably, the top face of the closure may comprise a raised area such as a raised button. On the raised area information for the end user may be provided. In one embodiment the information area may be located directly above the hydroscopic element retainer. The raised area may have user information formed permanently therein such as by moulding—alternatively it can form a receiving surface for a sticker or label or the like conveying information for the end user. In general the raise area will operate as a push button upon which a user will press to close the closure.

Desirably the stand for receiving and gripping the base end of the inner container are formed integrally with the retaining formations for retaining the hygroscopic element. In one arrangement the retaining formations are formed by opposing C-shapes (spaced apart and facing in opposing directions).

In one arrangement a snap-lock is arranged between the display board and the outer container to lock the display board in the first (display) position (—against movement about the hinge portion). Suitably the hinge portion is a flexible hinge. The or each flexible hinge may be reinforced (as described above for other hinges). In one arrangement two flexible hinges are provided at spaced apart positions. In such a construction it is desirable that the snap lock arrangement is located between the spaced apart hinges. In this way substantial manual pressure must be applied about the hinge portion to overcome the snap-lock and move the display board into the second position. Movement between the first and second position will typically involve movement about the hinge portion through approximately an angle of 180 degrees or greater.

Desirably the at least one hinge portion is provided at one (lower) end of the display board. Further it is desired that the at least one hinge portion attaches the display board to the outer container at a position proximate to or at the top end of the outer container. In a first position of the display board in this construction the display board extends substantially beyond (and suitably above) the outer container. In this way the display panel is clearly visible to a user.

Desirably the display panel and the outer container are provided with interengaging formations which (when engaged) hold the display panel in the second position.

Further in one construction an aperture is provided in the display panel. The aperture may function as a display hanger for hanging the outer container on a display shelf or the like. The aperture is desirably located proximate to the (top) end of the display board away from the (bottom) hinged end.

The interengaging formations may be a projection on the display panel and a rim on the outer container. The rim may also have attached thereto the hinge between the closure and the outer container and the hinge(s) between the display board and the container.

In one construction a tamper evident feature may be provided between the display panel and the outer container. In particular the tamper evident feature could be provided between the closure and the display panel. If either the closure were opened or the display panel were moved a frangible connection between the two would break indicating tampering with the product. The tamper evident feature may be alternatively or additionally provided between the closure and the top end of the container body. In particular the tamper evident feature could be a plug (inserted through the closure and the top end of the container) and if the closure were opened, a frangible connection (formed by the plug) between the closure and the top end of the container body would break indicating tampering of the product. The plug itself may break or the closure and/or the top end of the container may be left with open apertures indicating that tampering (removal of the plug) has taken place.

The tamper evident feature could additionally or alternatively be a frangible connection formed by a tear-way strip. The strip could be connected to the closure and the top end of the container. The strip may be torn away from the closure and the top end of the container indicating thus that the container may have been opened, for example that tampering (removal of the tear-away strip) has taken place. The tear-away strip may be fully removed from the closure and container. However in an alternative embodiment the tear away strip may remain (partially) connected to the closure or the top end of the container. Desirably, the tear-strip may be arranged so that it is frangibly connected to (the top end of) the container body. For example the tear-away strip may be connected to the closure or the top end of the container by one or more connection pieces arranged at one or more connection points. In this arrangement, the closure may be retained in a closed position by at least one retaining portion on the tear-strip.

In one arrangement the tear-away strip is connected to the container body and has retaining portions which extend over the closure to retain the closure in a closed position. In such an arrangement it is possible that the tear-away strip is connected only to the container and not the closure. In one particularly desirable arrangement the tear-away strip extends circumferentially about the mouth of the container. Suitably the tear-away strip extends from the front display side about one side to the rear side, for example to a position proximate a hinge for the display board. Desirably the tear-away strip is frangibly connected to the container in such a way that a lip on the closure (for example a lip intended to be used as a grip such as a thumb grip,) is not obstructed by any part of the tear-away strip or any frangible connection between the container and the tear-away strip when the strip is removed. Desirably therefore any connecting pieces between the tear-away strip and the container come away with the strip when it is removed. This may include a lip portion on the container. This has the advantage of leaving an exposed lip on the closure which can be used to open and close the closure as desired.

Desirably, the tear strip may comprise a pull tab. The pull tab may be formed by a region of the tear strip that is not connected to the top end of the container and/or the closure. The pull tab may aid the end user in attaining a grip on the tear-strip for manual removal of the tear-strip In order to avoid the display panel falling too far forward at least one stop may be provided between the display panel and the outer container, and in particular the closure therefor. In one embodiment there may be two stops provided between the display panel and the closure. Preferably the stops are arranged so that they do not interfere with the movement of the display panel between the first and second position. In one construction the stop(s) may be a (wedge shaped) protrusion from the display panel. Desirably, the stop(s) may be located on the display board above the hinge(s). The stops may engage with a rim on the outer container or the closure to prevent the display panel from falling too far forward.

One or more inner containers could be provided in a single outer container. Further the combination pack of the invention may include, as part of a kit, a dispensing nozzle or cannula adapted to fit the inner container and aid the application of product dispensed therefrom. The dispensing nozzle or cannula may be particularly useful with curable products such as cyanoacrylates.

One or both of, and desirably both of, the inner or outer containers can be moulded as a single piece for example from plastics material, thus making an integrally formed container which is relatively low cost to produce.

Desirably the outer container is also moulded as a single piece for example from plastics material, thus making an integrally formed container which is relatively low cost to produce. Apart from the body and closure the moulded piece would desirably include as appropriate the display board, the stand on the underside of the closure or the retaining formations as appropriate to the aspect(s) of the invention being adopted.

It is desirable that the inner container holds within its housing an environmentally sensitive product as an adhesive product. In particular it is desirable that the inner container holds within its housing a cyanoacrylate adhesive. Provision of the hygroscopic element within the outer container helps to increase the usable lifetime of an adhesive stored within the combined pack.

It will be appreciated that the inner container is removed from the outer container before use.

A suitable inner container is the container described and shown in International Patent Application No. PCT/IE01/00078 (Publication No. WO 01/94213) the entire contents of which are incorporated herein in their entirety by reference. In particular the inner container useful with the various aspects of the present invention may comprise a dispensing nozzle assembly with a re-useable break-off (or break-away) closure in the form of a cap. The nozzle assembly may be attachable to a container or integrally formed therewith. The nozzle may thus be closed with the cap after the cap has been broken off. The nozzle may be attachable to or integrally formed with a container and the containers contents are thus protectable by the re-useable cap. Snap-fit or other interengaging formations on the cap and the container may be used to retain the cap in place for storage.

The inner container according to any aspect of the present invention is desirably a hand-held phial. The phial may be constructed of deformable plastics so that it may be squeezable (by manual pressure and in particular finger pressure) to express product. Optionally the phial may be constructed of clear or translucent plastics. The plastics material can be sufficiently translucent to allow the level of product within the container to be determined by external viewing (through the sides of the container).

Figure 2:
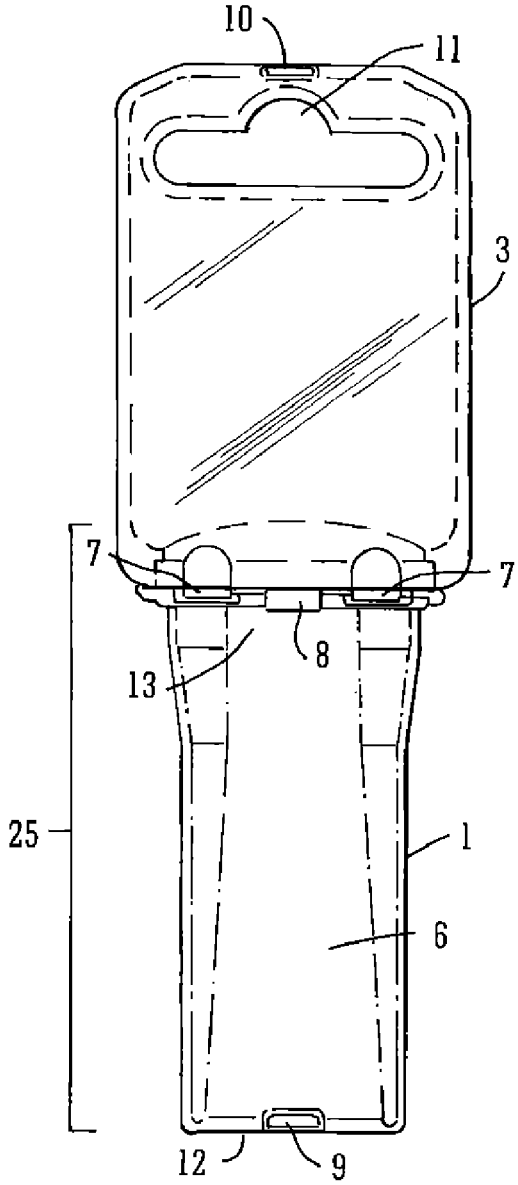
FIG. 2—Rear view of the outer container.
Figure 3:
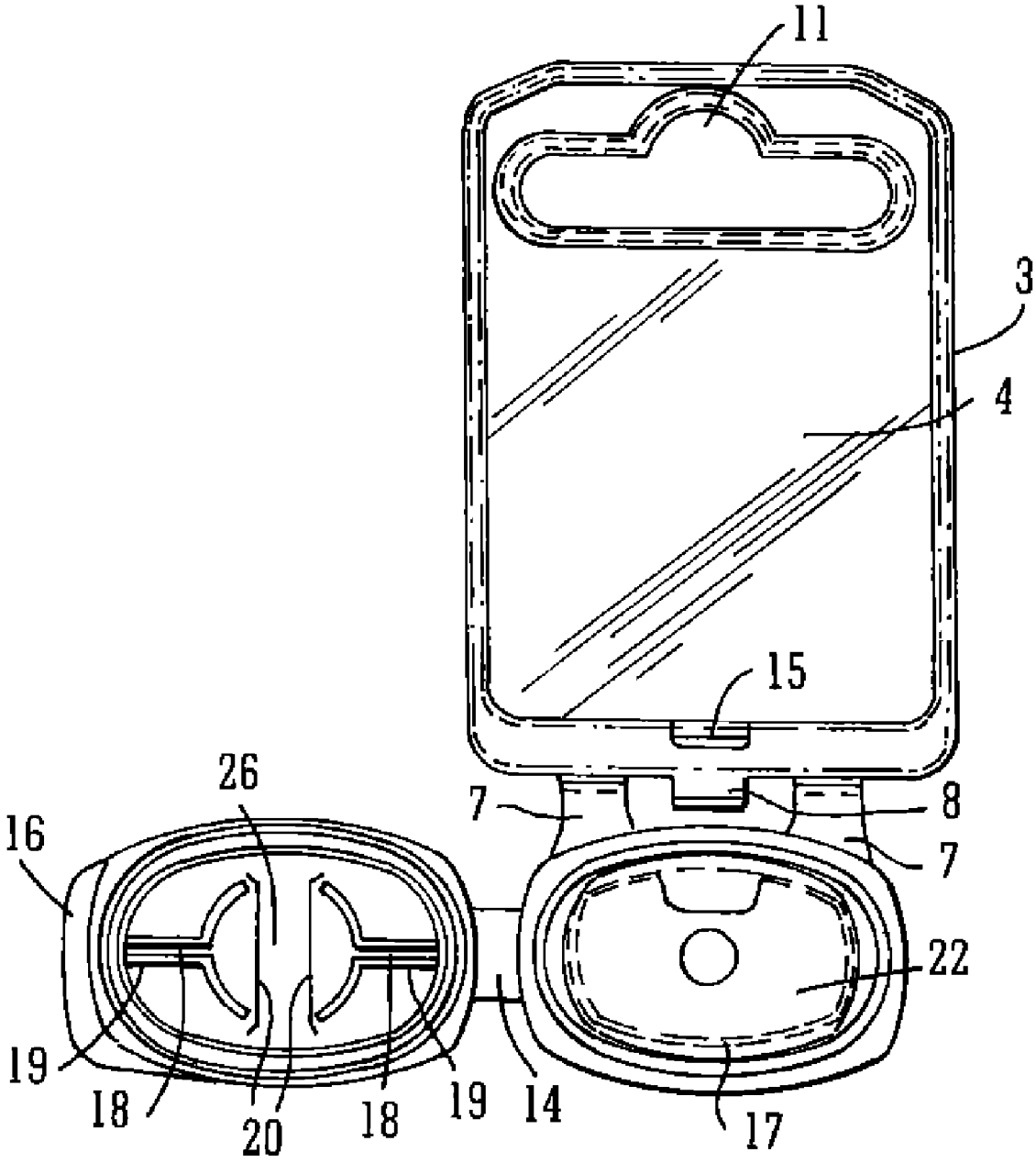
FIG. 3—Top plan view of the outer container.
Figure 6A:
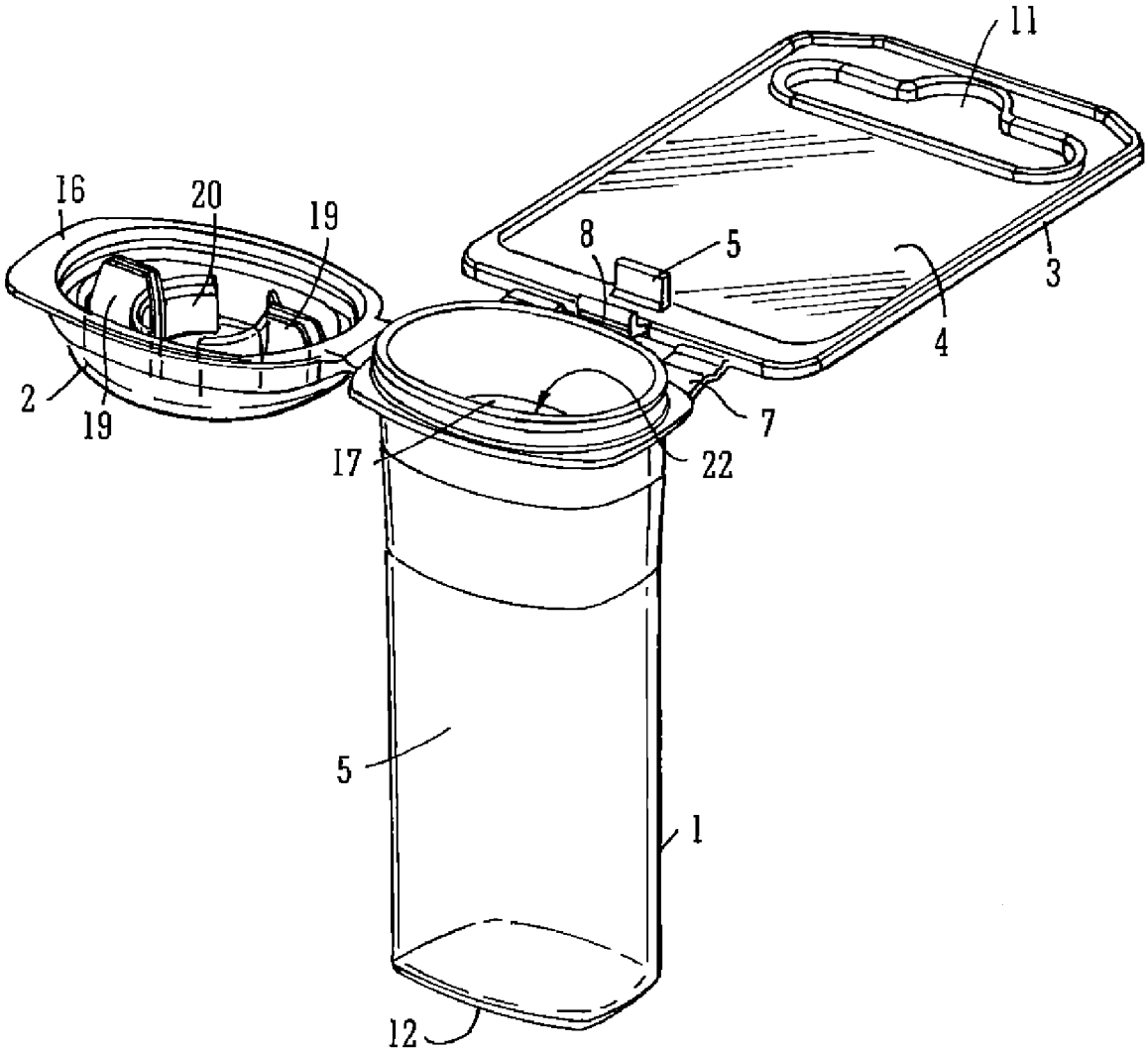
FIG. 6A—Perspective view of the outer container.
Figure 6B:
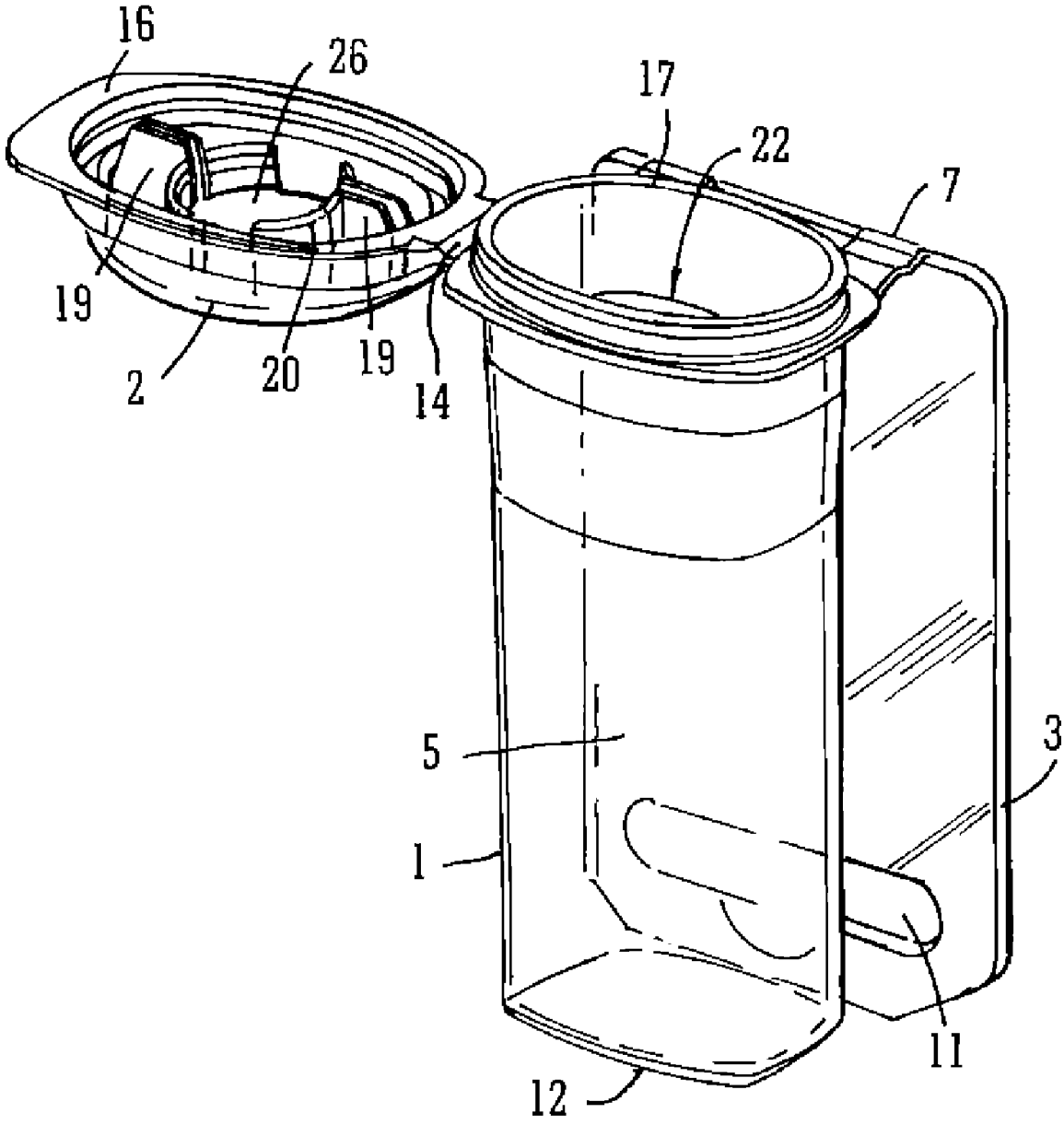
FIG. 6B—Perspective view of the outer container.
Figure 8:
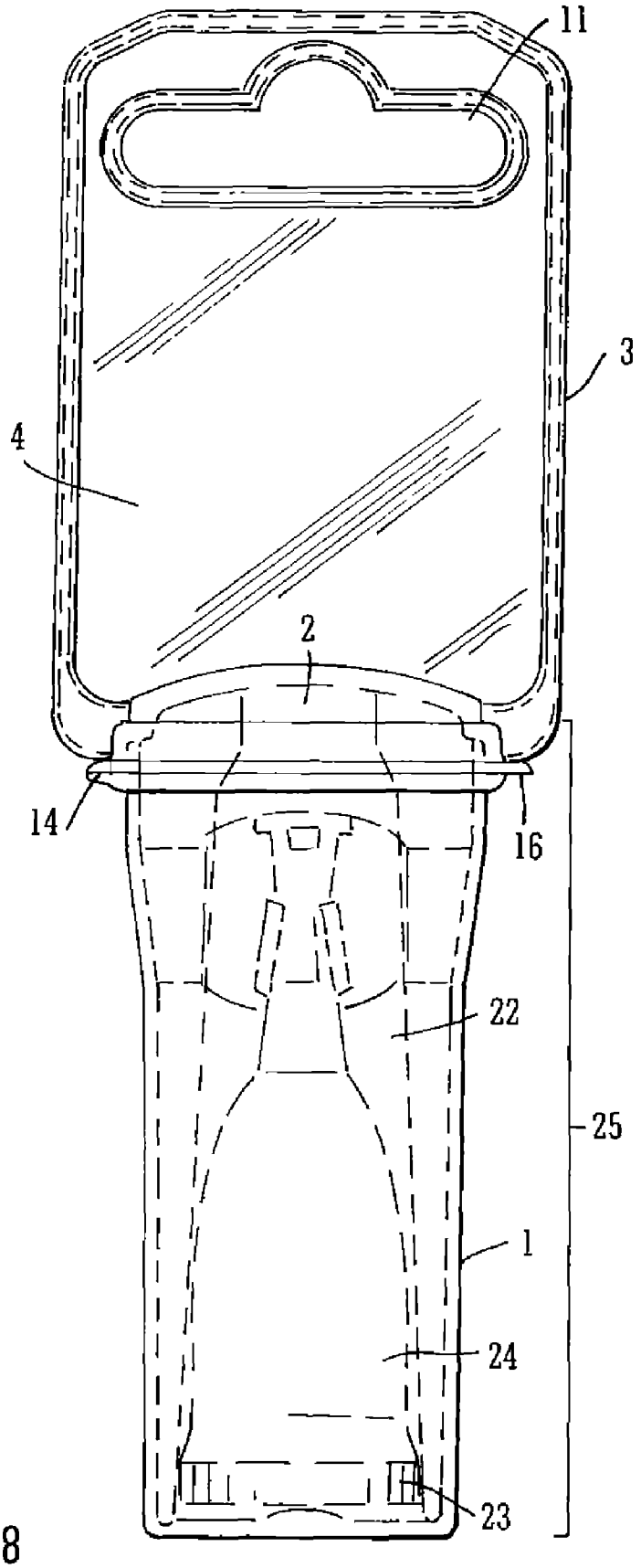
FIG. 8—Front view of inner container housed in outer container.
Figure 10A:
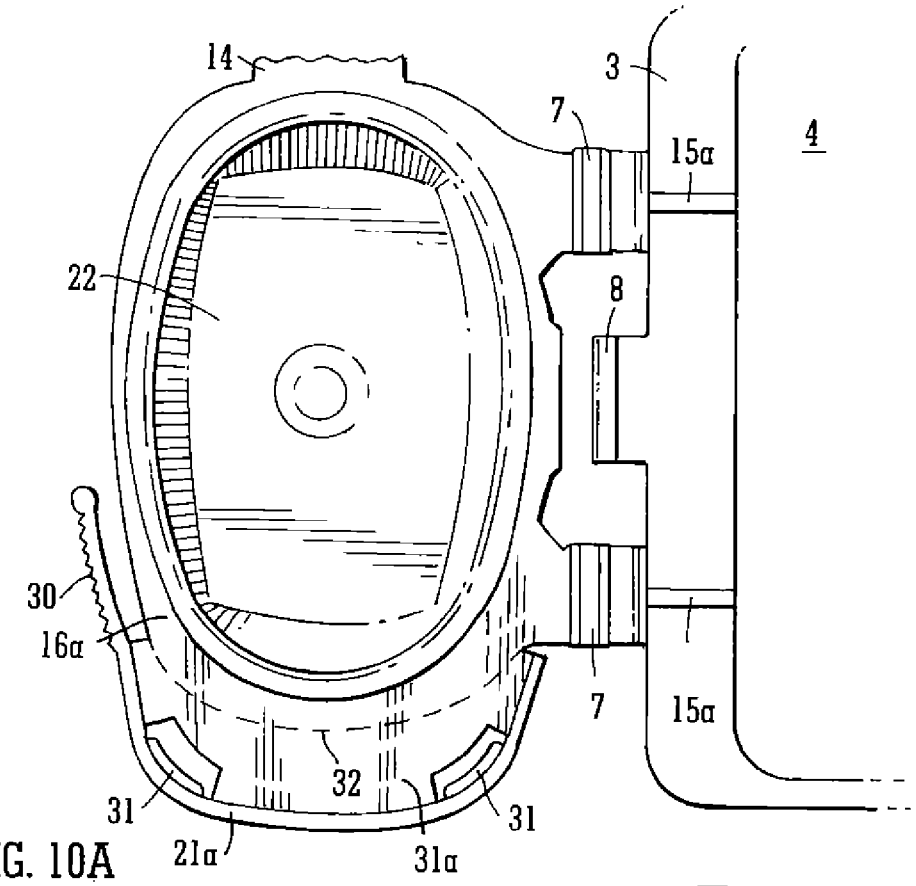
FIG. 10A—Top plan (enlarged) view of an alternative embodiment of outer container with a tamper evident feature and with the closure in the open position (not shown)
Figure 10B:
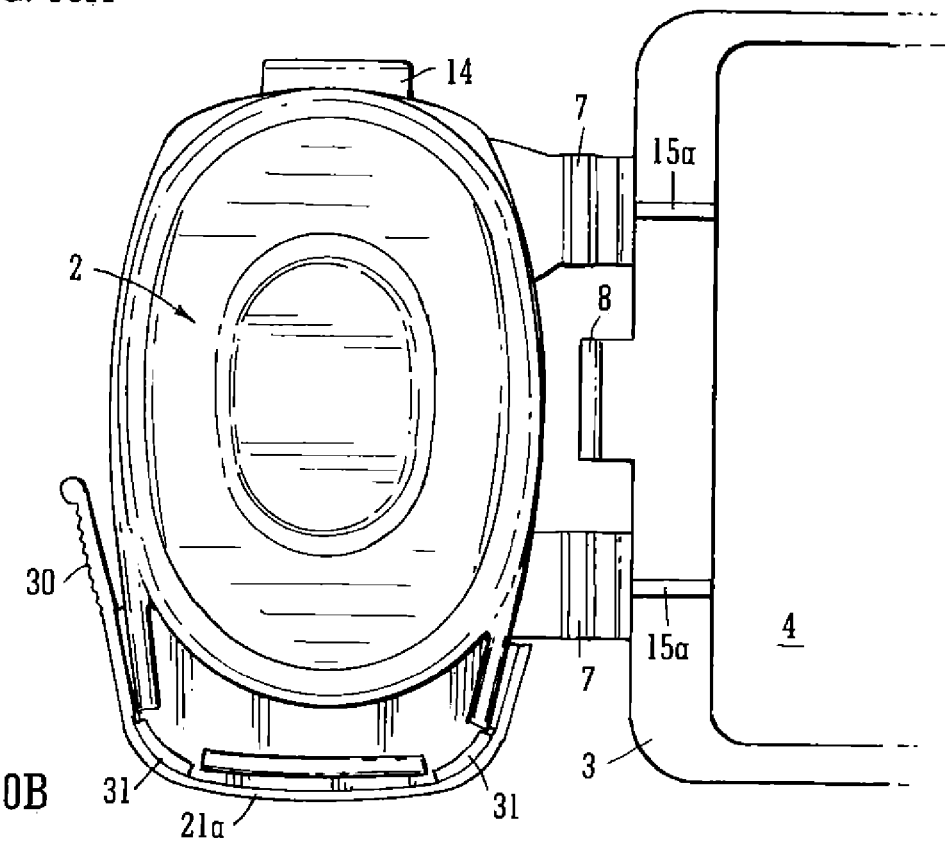
FIG. 10B—Top plan (enlarged) view of the outer container of FIG. 10A with the closure in the closed position.

As can be seen from FIGS. 1 and 2, the outer container 25 comprises a front display side 5 and a rear side 6 and a container body 1 having a base end 12 and a top end 13 and housing 22 for an inner container 24 as shown in FIG. 8. Product display information can be attached to the front display side 5 and/or the rear side 6. The container body 1 is provided with a lid 2 attached to the container body 1 by a hinge 14 and a display board 3. As illustrated in the embodiment of FIGS. 10A and 10B, the lid 2 may comprise an area 2A which is raised in respect to the upper surface of the lid 2. The raised area 2A provides an additional surface on which information for the end user can be placed. It forms a press button for pressing closed the lid 2. The display board 3 comprises a display panel 4 and an aperture 11. The display board 3 is hingedly attached to the container body 1 by at least one hinge 7, the display board 3 is rotatable about at least one hinge 7 between a first position (shown in FIG. 1) wherein the display board 3 is held in a position where the display panel 4 faces in the same direction as the front display side 5 of the container body 1 and a second position (shown in FIG. 6B) where the display panel 4 faces in the same direction as the rear side 6 of the container body 1. The display board 3 is provided with a snap fit 8 to retain the display board 3 in the first position and a projection 10 that inter-engages with the rim 9 of the rear side 6 of the container body 1 to retain the display board 1 in the second position. Product information can be displayed on the display panel 4 of the display board 4. As can be seen from FIG. 3, the display board 3 is further provided with a stop 15 that abuts the lid 2 to prevent the display board 3 from falling too far forward when the display board 3 is in position 1. As shown in the embodiment of FIGS. 10A/10B and 11A/11B two stops 15A may be provided between the display panel and the closure. In that embodiment the stops are arranged on the display board 4 above the hinges 7. The stops 15A engage with the lid 2 to prevent the display panel 4 from falling too far forward. As shown in FIG. 3, a rim 33 on the container body prevents the lid 2 from being pushed too far down the container body 2 when the lid 2 is in the closed position. The rim 33 also provides a point of attachment for flexible hinge 14 and at least one hinge 7. The rim 33 cooperates with the snap fit 8 to retain the display board 3 in the first position.

Figure 7:
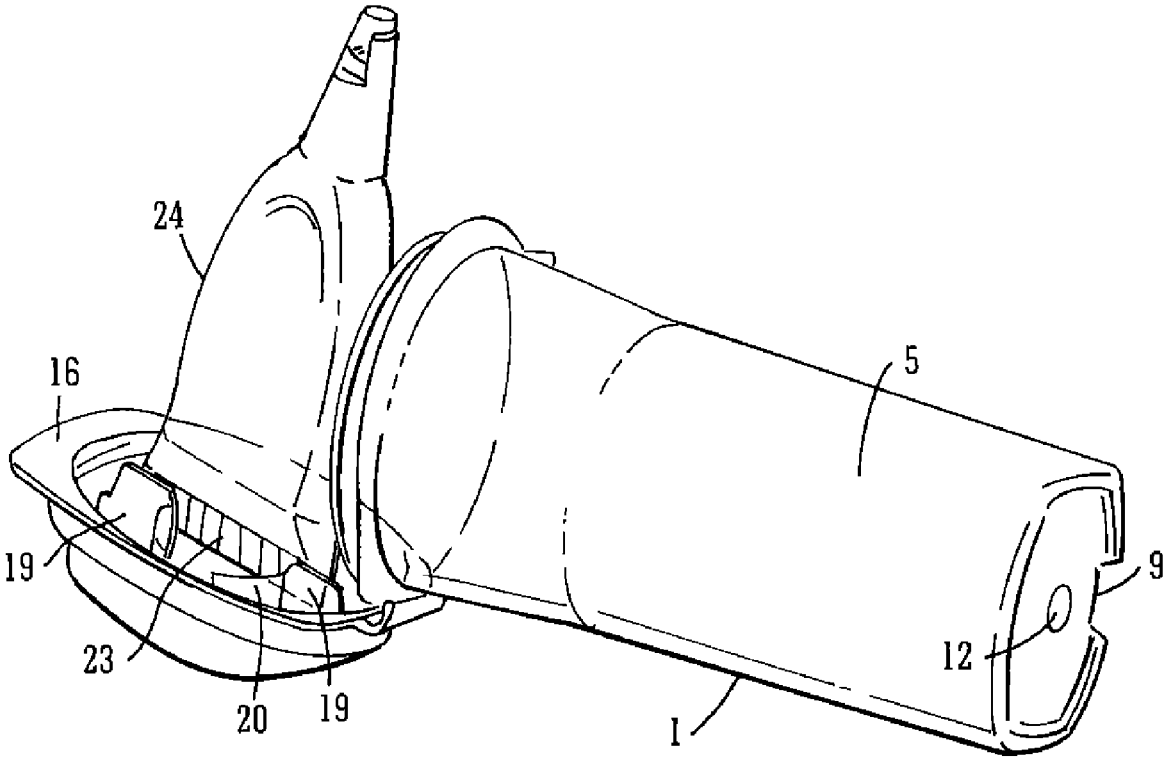
FIG. 7—Perspective view of the outer container retaining the inner container.

FIG. 3 shows the lid 2 in its open position whereby the mouth 17 and housing 22 can be viewed. The underside of the closure 2 comprises a thumb grip 16 for ease of opening and closing the lid 2 by the end user, a stand comprising a slot 18 formed by two pairs of opposing grips 19 and a retaining formation 26 comprised of two opposing C shapes 20. As can be seen from FIG. 7, the crimped end 23 of the inner container 24 engages with the slot 18, which retains the inner container 24 in a substantially upright position. The underside of the lid, as shown in FIG. 3, comprises a continuous upright member 30 which together with an outer rim 31 on the closure forms an annular channel 32 between the upright member 30 and the outer rim 31 of the lid 2. When the lid 2 is in the closed position, a rim 33 about the mouth 17 of the container body 1 seats into the channel 32 to provide an airtight seal between the closure and the outer container.

Figure 4A:
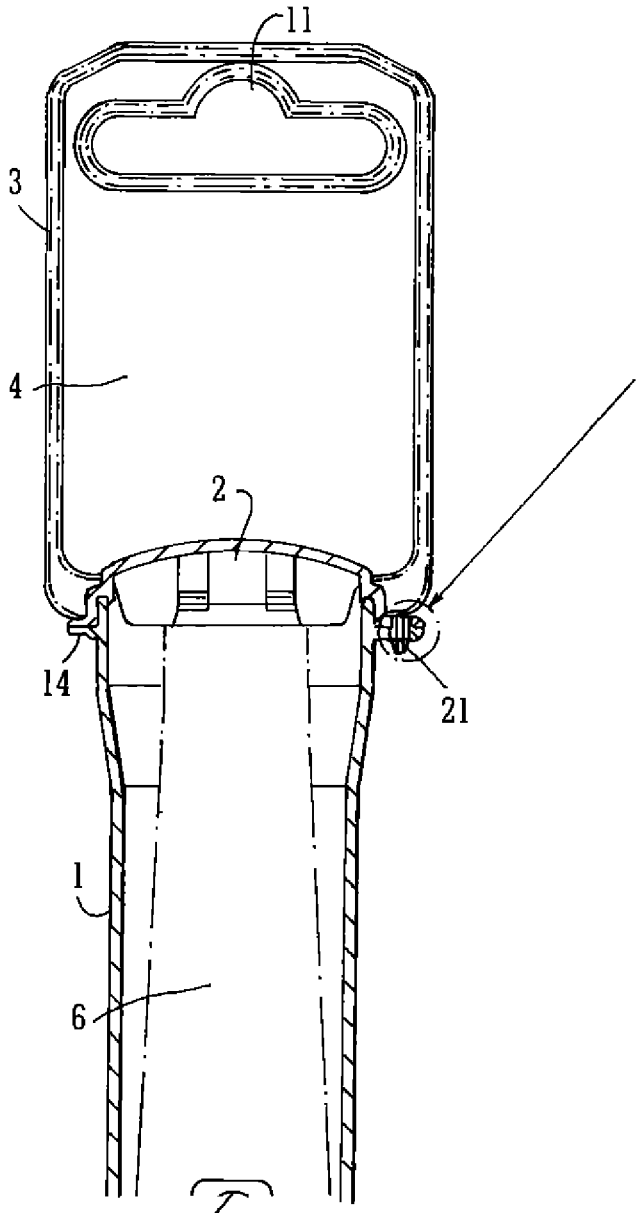
FIG. 4A—Front view of the outer container comprising a tamper evident feature.
Figure 4B:
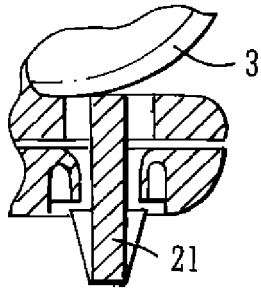
FIG. 4B—Enlarged front view of the tamper evident feature.
Figure 5B:
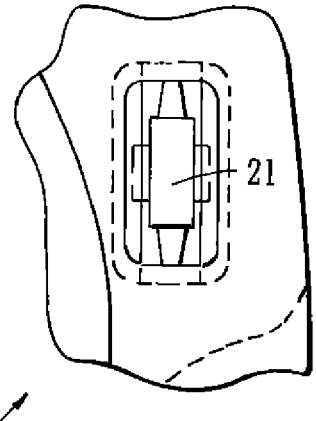
FIG. 5B—Enlarged top plan view of the tamper evident feature.
Figure 5A:
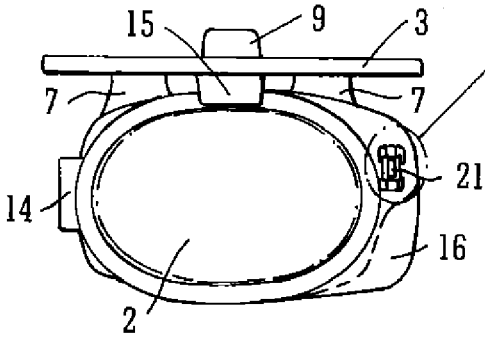
FIG. 5A—Top plan view of the outer container comprising a tamper evident feature.
Figures 11A, 11B:
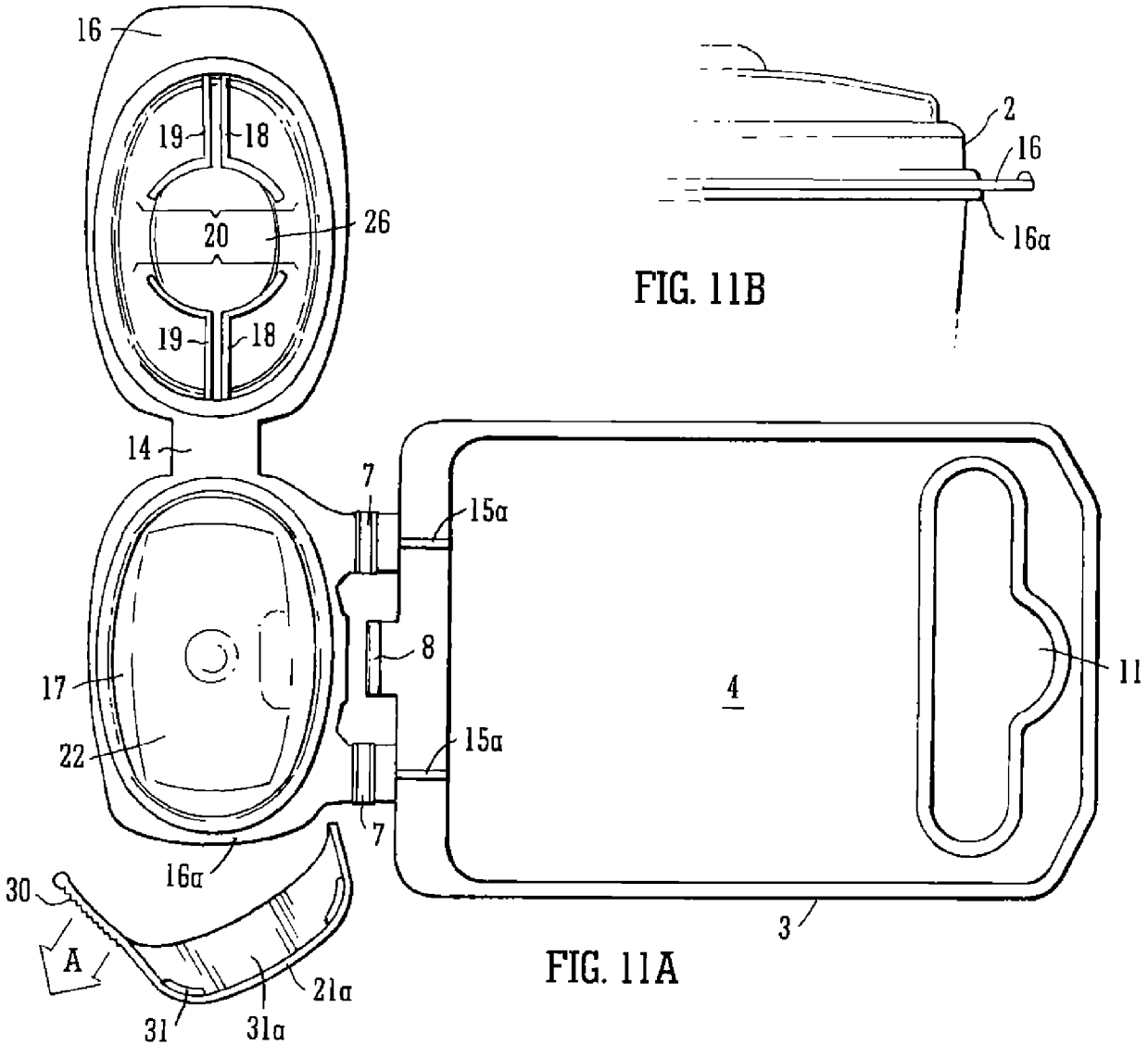
FIG. 11A—Top plan view of the outer container of FIGS. 10 A and 10B showing the open closure and with the tamper evident feature removed.
FIG. 11B—Side view of the outer container of FIG. 11A with the closure in the closed position.

FIGS. 4, 5, 10A/10B and 11A/11B illustrate an embodiment of the present invention wherein the container body 1 further comprises an optional tamper evident feature 21. The tamper evident feature 21 is provided between the lid 2 and the top end 13 of the container body 1. In FIGS. 4 and 5 the tamper evident feature is a plug (pin) 21 inserted through the lid 2 and the top end 13 of the container body 1. When the lid 2 is opened, a frangible connection (formed by the plug/pin) between the lid 2 and the top end 13 of the container body 1 will break indicating prior opening (possible tampering) of the product. In the embodiment indicated in FIGS. 10A/10B and 11A, the tamper evident feature is a tear-away strip 21A frangibly connected to the top end 13 of the container body 1. The strip 21A is torn away from the connection points (indicated by the dotted line 32 in FIGS. 10A and 10B) on the top end 13 of the container body 1 indicating that tampering (removal of the tear-away strip 21A) has taken place. In this embodiment, the tear-away strip 21A has at least one retaining portion 31 (in the embodiment two retaining portions) which extends over the lid 2 to retain the lid 2 in the closed position. For example the retaining portions 31 extend over the thumb grip 16 of the lid 2. In the embodiments illustrated in FIGS. 10A and 10B, the strip 21A has two retaining portions 31. The retaining portions 31 may be spaced about the strip 21A. Alternatively the retaining portions 31 may be arranged side-by-side on the strip 21A. In the arrangement illustrated in FIGS. 10A and 11A the strip 21A extends circumferentially about the mouth 17 of the container body 1. The strip 21A extends from the front display side 5 about one side of the container to the rear display side 6 to a position proximate a hinge 7. In this embodiment, the strip 21A is connected to the container body 1 so that when removed, none of the tear-away strip 21A obstructs the thumb grip 16 of the lid 2. The strip 21A has a connecting piece 31A which is in the form of a lip on the container and which detaches with the tear-away strip 21A. The at least one connecting piece 31A is located between the strip 21A and the container body 1. In use, when the strip 21A is removed from the container body 1 (as illustrated in FIG. 11A) connecting piece(s) 31A come away with the strip 21A. Removal of the connecting piece(s) 31A reduces the size of the lip 16A of the container body 1. The piece 31A can be considered a part of the lip portion 16A until removed. As shown in the embodiment of FIG. 11B, the thumb grip 16 is formed by a protruding lip of the lid 2 which protrudes further than the lip 16A when the strip 21A is removed.

The tear strip comprises a pull tab 30. The pull tab 30 is formed by a region of the tear strip 21A that is not connected to the top end 13 of the container body 1 and/or the lid 2. The pull tab 30 will assist the end user in securing a grip on the tear-strip 21A.

Figure 9A:
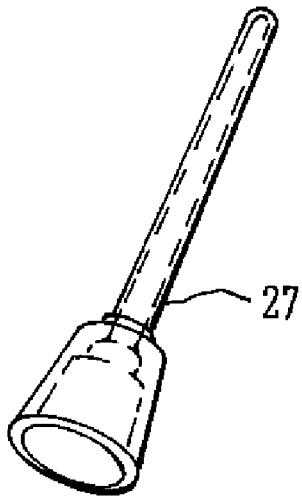
FIG. 9A—Perspective view of a cannula suitable for attachment to an inner container.
Figure 9B:
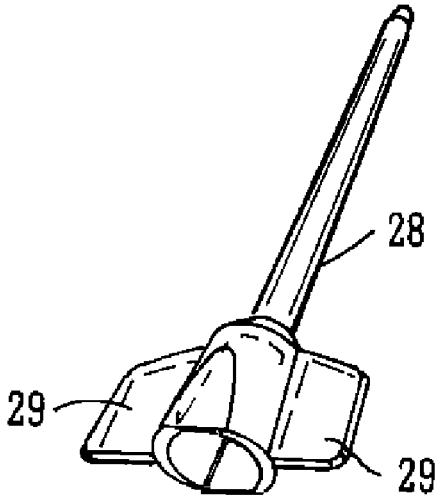
FIG. 9B—Perspective view of an alternative cannula suitable for attachment to an inner container.

FIGS. 9A and 9B show respectively a perspective view of a cannula 27 suitable for attachment to an inner container 24, and a further cannula 28 provided with wings or grips 29 for ease of manual orientation/attachment. The cannulas 28 or 29 are provided for ease of dispensing material from the inner container 24.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A container having a front display side and a rear side comprising:

(i) a container body having opposing first and second ends and defining a housing into which an object or material can be placed and a mouth at the second end of the housing through which the object or material can be placed into the housing;

(ii) a closure selectively pivotable between an open position wherein the object or material can be placed through the mouth into the housing and a closed position wherein the closure is engaged with the mouth of the container body to seal the housing from air or moisture in the environment outside of the housing;

(iii) a display board connected to the container by at least one hinge portion and having a display panel on which product information can be displayed, the display board being pivotable about the at least one hinge portion between a first position wherein the display board is held in a position where the display panel faces in the same direction as the front display side of the container and a second position wherein the display panel faces in the same direction as the rear side of the outer container, further comprising a tamper evident feature to provide a permanent indication when the closure is moved from the closed position or when the display board is moved from the first position wherein the tamper evident feature is a frangible connection between the closure and the display board.

2. A container as claimed in claim 1 wherein the tamper evident feature is additionally a frangible connection between the closure and the container body.

3. A container as claimed in claim 1 wherein the tamper evident feature is selected from the group consisting of plugs, pins, tear-way strips or combinations thereof.

4. A container as claimed in claim 1 wherein the container has a base arranged to maintain the container in a standing position when the container is placed in an upstanding position on said base.

5. A container as claimed in claim 1 wherein the lid is mounted on the container body by at least one flexible hinge.

6. A container as claimed in claim 1 wherein the lid is a snap fit to the container.

7. A container as claimed in claim 1 wherein the display board is retained in the first position by a snap fit.

8. A container as claimed in claim 1 wherein the display board is retained in the second position by interengaging members.

9. A container as claimed in claim 8 wherein the interengaging members comprise a projection and a rim.

10. A container as claimed in claim 9 wherein the projection is on the display panel and the rim is on the container.

11. A container as claimed in claim 1 wherein the display board further comprises a stop to prevent the display board from travelling too far forward in the first position.

12. The container as claimed in claim 1 wherein the body is molded as a single piece and the mouth is the only opening into the housing.

13. A sealable container, comprising:

a polymeric, elongated hollow body having a front, a back, a permanently sealed end, an internal wall defining an internal cavity, and a single opening into the internal cavity defined by an open end opposing the closed end, wherein product can be placed into the cavity through the opening;

a snap fit closure selectively pivotable between an open position wherein product can be placed into the cavity through the opening and a closed position wherein the closure seals the cavity from air or moisture in the environment outside the body; and a display board having a free end, a support end opposing the free end, a display board hinge connecting the support end to the body, and a display face intermediate the free end and the support end on which product information can be displayed, wherein the free end is pivotable around the display board hinge from a first position wherein the display face is in the same direction as the body front, the display board support end is proximate the body open end, and the display board free end extends away from the body to a second position wherein the display face is in the same direction as the body back, the display board support end is proximate the body open end, and the display board is adjacent the body back, further comprising a tamper evident feature to provide a permanent indication when the closure is moved from the closed position or when the display board is moved from the first position wherein the tamper evident feature is a frangible connection between the closure and the display board.

14. The sealable container of claim 13 wherein in the second position the display board free end is proximate the body closed end.

15. The sealable container of claim 13, wherein a closure hinge connects the closure to the body adjacent the open end, and the closure hinge defines a pivot axis that is perpendicular to a pivot axis defined by the display board hinge.

16. The sealable container of claim 13, wherein the closure has an external surface and an internal surface and comprising grips projecting from the internal surface to hold product in a fixed relationship relative to the internal surface.

17. The sealable container of claim 13, wherein one of the open end or the closure comprises an annular channel and the other of the open end or the closure comprises a rim that snap fit engages with the annular channel when the closure is in the closed position to provide an airtight seal between the cavity and the environment outside the body.

18. The sealable container of claim 13, wherein the display board hinge is a flexible hinge unitarily molded between the display board and the body adjacent the open end; and further comprising a flexible closure hinge unitarily molded between the closure and the body adjacent the open end.

19. A resealable container, comprising: a unitarily molded, polymeric, elongated hollow body having a front, a back, a sealed end, an internal wall defining an internal cavity, and a single opening into the internal cavity defined by an open end opposing the sealed end, wherein a product can be placed into the cavity through the opening; a closure comprising an external surface, an internal surface, a pair of spaced grips projecting from the internal surface to hold the product between the grips in a fixed relationship relative to the internal surface, a flexible hinge unitarily molded between the closure and the body adjacent the open end, the closure selectively pivotable around a closure pivot axis between an open position wherein the opening is exposed and a closed position wherein the closure overlies the opening, one of the open end or the closure comprising an annular channel and the other of the open end or the closure comprising a rim, wherein a user can axially move the closure toward the body open end to snap fit engage the annular channel and the rim and provide an airtight seal between the cavity and the environment outside the body and a user can axially move the closure away from the body open end to disengage the annular channel and the rim; and a display board having a free end, a support end opposing the free end, a flexible hinge unitarily molded between the display board and the body, a display face and an opposing back face, and an aperture between the display face and back face defined in the free end, wherein the free end is pivotable around a display board pivot axis perpendicular to the closure pivot axis, the display board pivotable from a first position wherein the display face is in the same direction as the body front, the back face is in the same direction as the body back, the display board support end is proximate the body open end, and the display board free end extends away from the body to a second position wherein the display face is in the same direction as the body back, the back face is in the same direction as the body front and adjacent to the body back, the display board support end is proximate the body open end, and the free end is adjacent the body closed end, the display board comprising a projection extending from the display board back face that is engageable within an aperture defined in the first end of the body to selectively retain the display board in the second position, further comprising a tamper evident feature to provide a permanent indication when the closure is moved from the closed position or when the display board is moved from the first position wherein the tamper evident feature is a frangible connection between the closure and the display board.

* * * * *